US009083112B2

(12) United States Patent
Asai et al.

(10) Patent No.: US 9,083,112 B2
(45) Date of Patent: Jul. 14, 2015

(54) MAGNETIC COUPLING CONNECTOR

(71) Applicant: SMK Corporation, Tokyo (JP)

(72) Inventors: Kiyoshi Asai, Yokohama (JP); Toshihiko Kato, Kawasaki (JP); Koichi Izawa, Tokyo (JP); Shintaro Nonaka, Saitama (JP); Yutaka Nakaone, Chiba (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/182,239

(22) Filed: Feb. 17, 2014

(65) Prior Publication Data

US 2014/0322929 A1 Oct. 30, 2014

(30) Foreign Application Priority Data

Apr. 25, 2013 (JP) ..... 2013-092739

(51) Int. Cl.

*H01R 11/30* (2006.01)
*H01R 13/62* (2006.01)
*H01R 13/24* (2006.01)

(52) U.S. Cl.

CPC ..... *H01R 13/6205* (2013.01); *H01R 11/30* (2013.01); *H01R 13/2421* (2013.01)

(58) Field of Classification Search

CPC ..... H01R 13/6205; H01R 11/30
USPC ..... 439/39, 38, 40, 246
See application file for complete search history.

(56) References Cited

U.S. PATENT DOCUMENTS

| | | | | |
|---|---|---|---|---|
| 3,521,216 | A * | 7/1970 | Tolegian | 439/39 |
| 4,317,969 | A * | 3/1982 | Riegler et al. | 200/52 R |
| 5,829,987 | A * | 11/1998 | Fritsch et al. | 439/38 |
| 6,966,781 | B1 * | 11/2005 | Bullinger et al. | 439/38 |
| 7,351,066 | B2 | 4/2008 | DiFonzo et al. | |
| 2013/0273752 | A1 * | 10/2013 | Rudisill et al. | 439/39 |
| 2013/0295781 | A1 * | 11/2013 | Gualino et al. | 439/39 |
| 2014/0087569 | A1 * | 3/2014 | Lee | 439/39 |

FOREIGN PATENT DOCUMENTS

| | | | |
|---|---|---|---|
| JP | H1-142174 | U | 9/1989 |
| JP | 2003-303646 | A | 10/2003 |
| JP | 4774439 | B2 | 7/2011 |

OTHER PUBLICATIONS

Notice of Office Action for Japanese Patent Application No. 2013-092739, issued by the Japan Patent Office on Mar. 6, 2015.

* cited by examiner

*Primary Examiner* — Neil Abrams
*Assistant Examiner* — Travis Chambers

(57) ABSTRACT

The magnetic coupling connector includes: first and second connector main bodies to be coupled with each other; a magnet member disposed in a coupling portion of the first connector main body and a mate-side magnetic material disposed in a coupling portion of the second connector main body, the magnet member in the first connector main body adsorbing onto the mate-side magnetic material in the second connector main body, thereby coupling the connector main bodies together; and a contact terminal disposed in the coupling portion of the first connector main body and a contact terminal disposed in the coupling portion of the second connector main body, the contact terminals being pressed against each other when coupled. In the magnetic coupling connector, the magnet member is held by the first connector main body so as to be allowed to swing.

4 Claims, 8 Drawing Sheets

MAGNETIC COUPLING CONNECTOR

CROSS REFERENCE TO RELATED APPLICATION

The contents of the following Japanese patent application are incorporated herein by reference, NO. 2013-092739 filed on Apr. 25, 2013.

FIELD

The present invention relates to a magnetic coupling connector that produces an electrical connection by magnetically coupling a pair of connector main bodies thereof together.

BACKGROUND

Conventionally, in order to connect an electronic device such as a mobile phone or a smartphone to a connection cable such as a charging cable, a magnetic coupling connector that magnetically couples one of connector main bodies (hereinafter referred to also as the "first connector main body") attached to one end of the connection cable with the other of the connector main bodies (hereinafter referred to also as the "second connector main body") built into the electronic device has been widely used (see Patent Literature 1, for example).

According to this magnetic coupling connector, a first connector main body 100 and a second connector main body 102 to be coupled with each other include a magnet 101 provided in a coupling portion thereof and a magnet or magnetic material 103 provided in a coupling portion thereof, respectively. When the connector main bodies 100 and 102 are coupled with each other by a magnetic force from the magnets, movable contact terminals 104a and 104b, disposed in the coupling portion of the first connector main body 100 and composed of, for example, pogo pins, are pressed against fixed contact terminals 105 disposed in the coupling portion of the second connector main body 102. As a result, the connector main bodies 100 and 102 are electrically connected to each other.

According to such a conventional connector main body 100, a housing 106 made of an insulating resin includes a recessed magnet accommodating portion 107 opened on a coupling surface side. The magnet 101 is fitted into the magnet accommodating portion 107 by means of press fitting and thereby fixed so as to be exposed at the coupling portion.

CITATION LIST

Patent Literature

Patent Literature 1: Japanese Patent No. 4774439

SUMMARY

Technical Problem

According to the conventional technique as described above, however, due to the configuration in which the magnet 101 is fixed to the housing 106 by means of press fitting, if the magnet 101 is fixed to the housing 106 in an inclined manner, a gap 108 may be generated between the magnet 101 and the magnetic material 103 as illustrated in FIG. 10A when the connector main bodies 100 and 102 are coupled with each other, resulting in a reduction in the magnetic force.

On the other hand, as illustrated in FIG. 10B, if the magnet 101 is fixed to the housing 106 in an inclined manner and the magnet 101 and the magnetic material 103 adsorb to each other with no gap therebetween, the connector main bodies 100 and 102 are coupled with each other while being inclined to each other. As a result, one end of the connector main body 100 is separated away from the second connector main body 102. Due to an insufficient travel distance (stroke amount) of the movable contact terminal 104b disposed on the separated side, a loose connection may be generated between the contact terminals 104b and 105.

Therefore, the conventional magnetic coupling connector as described above requires a high accuracy for the operation of pressing the magnet or the magnetic material into the housing. However, a rare-earth magnet such as a neodymium magnet, which is now widely used, by nature has difficulty in being molded with a high accuracy. Therefore, a large tolerance needs to be provided, thereby leading to a problem that a stable fixing state with respect to the housing is hard to achieve.

In view of such problems in association with the conventional technique, it is an object of the present invention to provide a magnetic coupling connector excellent in productivity and capable of obtaining a stable coupled or connected state.

Solution to Problem

In order to solve the problems in association with the conventional technique as described above and achieve the desired object, a first aspect of the present invention provides a magnetic coupling connector comprising: first and second connector main bodies to be coupled with each other; a magnet member disposed in a coupling portion of the first connector main body and a mate-side magnet member or magnetic material disposed in a coupling portion of the second connector main body, the magnet member in the first connector main body adsorbing onto the mate-side magnet member or magnetic material in the second connector main body, thereby coupling the connector main bodies together; and a contact terminal disposed in the coupling portion of the first connector main body and a contact terminal disposed in the coupling portion of the second connector main body, the contact terminals being pressed against each other when coupled, wherein the magnet member is held by the first connector main body so as to be allowed to swing.

In accordance with a second aspect of the present invention, the mate-side magnet member or magnetic material is held by the second connector main body so as to be allowed to swing in addition to the configuration according to the first aspect.

In accordance with a third aspect of the present invention, each of the connector main bodies includes a plurality of the contact terminals symmetrically arranged with the magnet member interposed therebetween in addition to the configuration according to the first or second aspect.

In accordance with a fourth aspect of the present invention, in addition to the configuration according to the first, second, or third aspect, the connector main body includes a magnet-inserted portion opened at opposite ends thereof in a coupling direction and into which the magnet member is inserted, a holding notch portion formed in a recessed shape at a rear end edge of the magnet-inserted portion, and a rear end closing member for closing a rear end side of the holding notch portion; the magnet member includes, at a rear end thereof, a flange-shaped held portion to be fitted into the holding notch portion; and swing clearances are formed between an inner peripheral surface of the magnet-inserted portion and the magnet member, between the held portion and an inner peripheral surface of the holding notch portion, and between the rear end closing member and a rear end face of the held portion, respectively, so that the magnet member is held by the first connector main body so as to be allowed to swing.

In accordance with a fifth aspect of the present invention, in addition to the configuration according to the fourth aspect, the magnet member is formed to have the flange-shaped held portion at the rear end thereof by fixing, to a rear end of a magnet, a flange plate with a size greater than a cross-section of the magnet in the coupling direction.

As described above, the magnetic coupling connector according to the present invention includes: first and second connector main bodies to be coupled with each other; a magnet member disposed in a coupling portion of the first connector main body and a mate-side magnet member or magnetic material disposed in a coupling portion of the second connector main body, the magnet member in the first connector main body adsorbing onto the mate-side magnet member or magnetic material in the second connector main body, thereby coupling the connector main bodies together; and a contact terminal disposed in the coupling portion of the first connector main body and a contact terminal disposed in the coupling portion of the second connector main body, the contact terminals being pressed against each other when coupled. In such a magnetic coupling connector, the magnet member is held by the first connector main body so as to be allowed to swing. Thus, when both connector main bodies are coupled with each other, the magnet member and the mate-side magnet member or magnetic material always adsorb to each other over the entire adsorption surfaces thereof, thereby generating no gap between the adsorption surfaces. It is therefore possible to prevent a loss in the magnetic force and to obtain a stable adsorbed state therebetween. It is also possible to obtain a stable contact state without an inclination in the magnet member or the mate-side magnet member or magnetic material influencing a contact stroke between the contact terminals of the connector main bodies.

Moreover, according to the present invention, the mate-side magnet member or magnetic material is held by the second connector main body so as to be allowed to swing. As a result, a higher degree of freedom can be obtained.

Furthermore, according to the present invention, each of the connector main bodies includes a plurality of the contact terminals symmetrically arranged with the magnet member interposed therebetween. Therefore, a reaction force against the adsorption force of the magnet member is diverged into and exerted on the contact terminals. Therefore, even if the magnet member is positioned in an inclined manner, the connector main bodies are coupled with each other with a parallel arrangement therebetween.

Furthermore, according to the present invention, the connector main body includes: a magnet-inserted portion opened at opposite ends thereof in a coupling direction and into which the magnet member is inserted; a holding notch portion formed in a recessed shape at a rear end edge of the magnet-inserted portion; and a rear end closing member for closing a rear end side of the holding notch portion. Also, the magnet member includes, at a rear end thereof, a flange-shaped held portion to be fitted into the holding notch portion. Swing clearances are also formed between an inner peripheral surface of the magnet-inserted portion and the magnet member, between the held portion and an inner peripheral surface of the holding notch portion, and between the rear end closing member and a rear end face of the held portion, respectively. The magnet member is thereby held by the first connector main body so as to be allowed to swing. Thus, the magnet member can be easily assembled into the connector main body so as to be allowed to swing.

Furthermore, according to the present invention, the magnet member is formed to have the flange-shaped held portion at the rear end thereof by fixing, to a rear end of a magnet, a flange plate with a size greater than a cross-section of the magnet in the coupling direction. Therefore, the magnet portion such as a difficult-to-mold rare-earth magnet can have a simple shape. It is therefore possible to manufacture the magnet member inexpensively. Also, the magnet member can accommodate a plurality of coupling heights by changing a thickness of the magnet in the coupling direction. A cost reduction can be therefore achieved.

DESCRIPTION OF EMBODIMENTS

Figure 1:
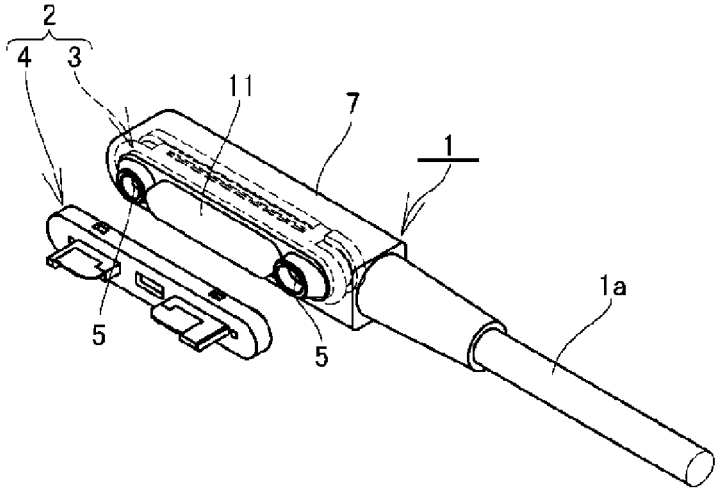
FIG. 1 is an exploded perspective view illustrating one example of a state when a magnetic coupling connector according to the present invention is used.
Figure 2:
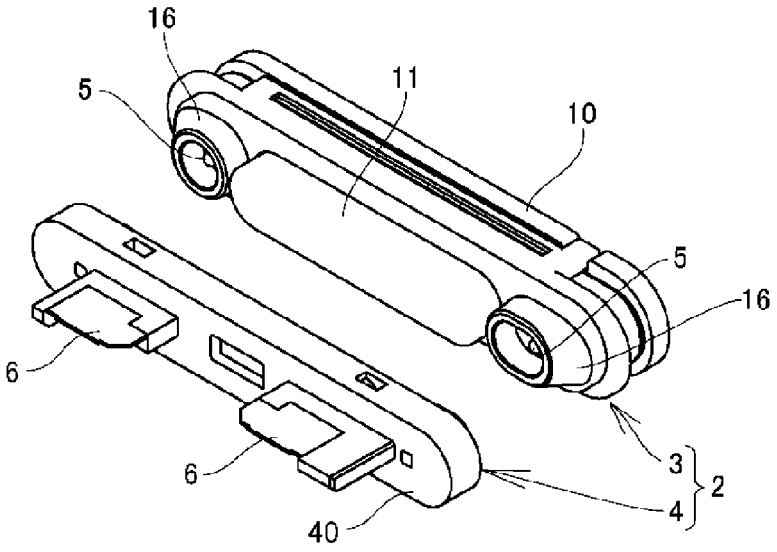
FIG. 2 is an exploded perspective view of the magnetic coupling connector according to the present invention.
Figure 3:
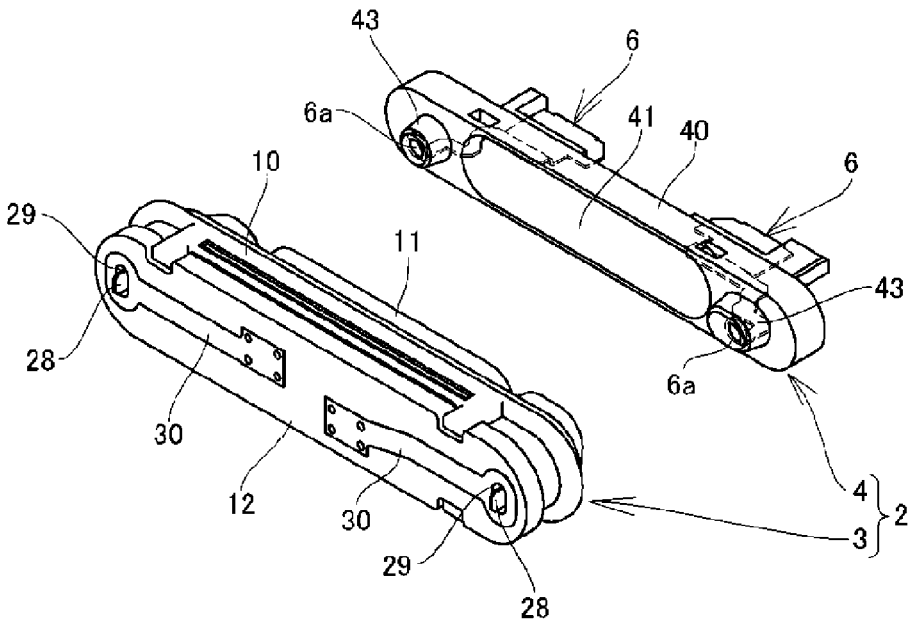
FIG. 3 is an exploded perspective view of the same as viewed from another angular direction.
Figure 4:
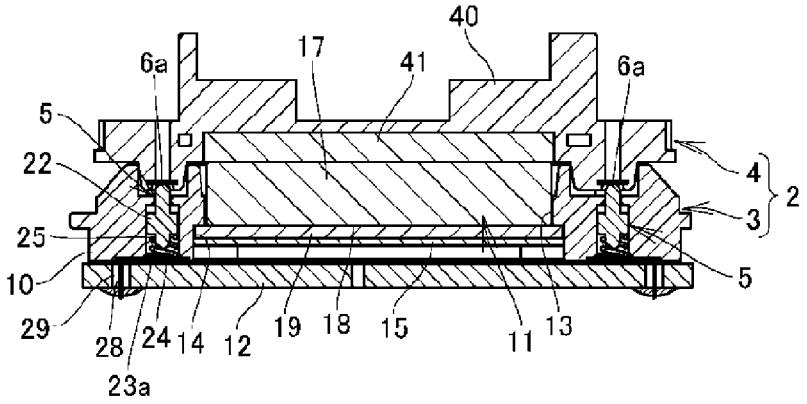
FIG. 4 is a cross-sectional view of the same.
Figure 5:
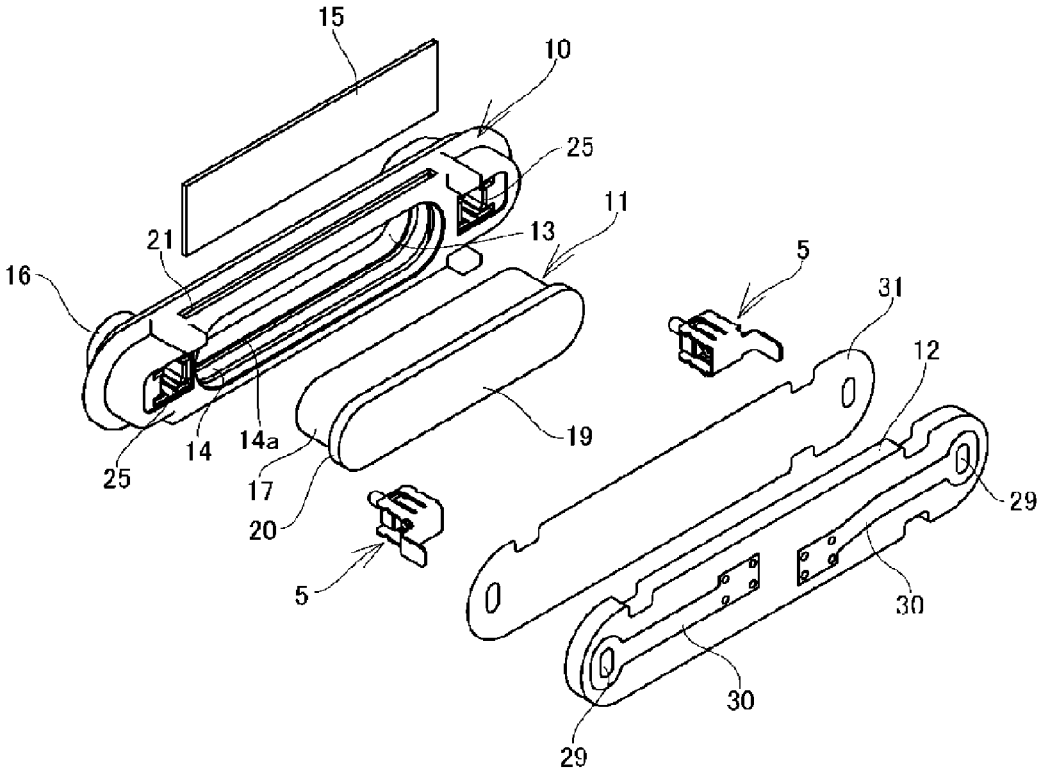
FIG. 5 is an exploded perspective view of a first connector main body in FIG. 1.
Figure 6A:
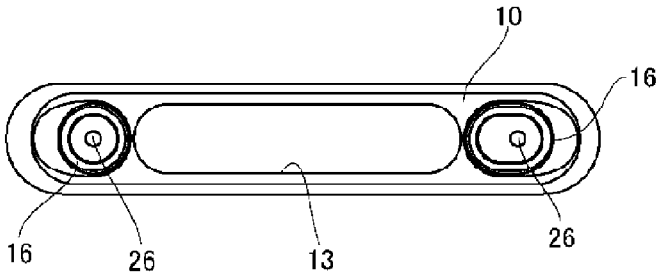
FIG. 6A is a front view of a housing in FIG. 5.
Figure 6B:
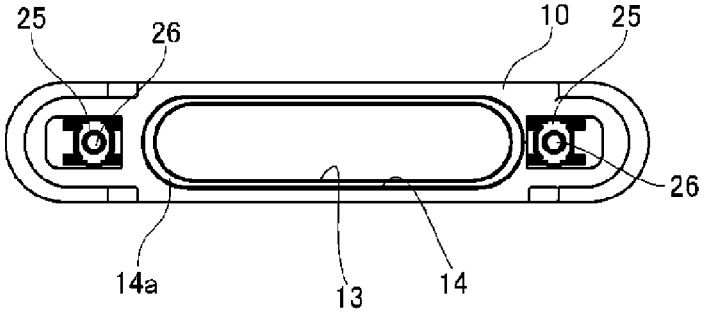
FIG. 6B is a back view of the same.
Figure 6C:
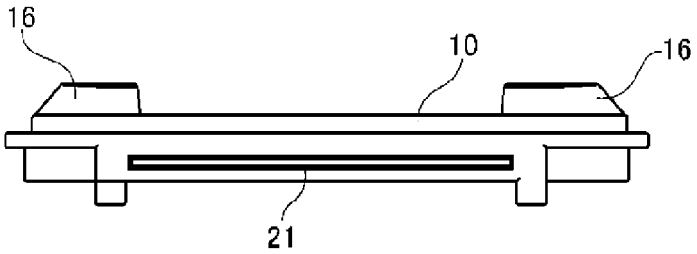
FIG. 6C is a plan view of the same.
Figure 6D:
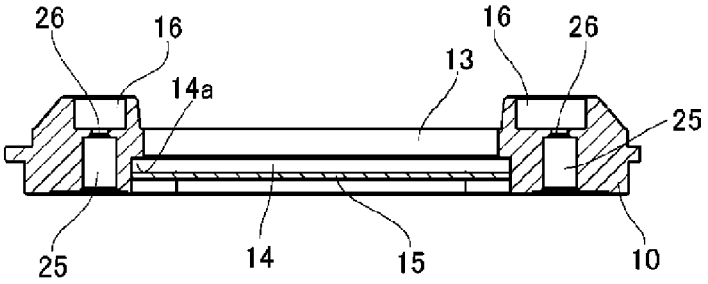
FIG. 6D is a transverse cross-sectional view of the same.

An embodiment of a magnetic coupling connector according to the present invention will now be described below based on examples shown in FIGS. 1 to 9B. Note that reference numeral 1 in these figures denotes a connection cable such as a charging cable.

The magnetic coupling connector 2 includes a pair of connector main bodies 3 and 4 (referred to also as the "first connector main body 3" and the "second connector main body 4," respectively) to be coupled with each other. The first connector main body 3, attached to one end of the connection cable 1 such as a charging cable, is magnetically coupled with the second connector main body 4 built into an electronic device. As a result, contact terminals 5 and 6 disposed in coupling portions of the connecter main bodies 3 and 4, respectively, are pressed against each other, thereby electrically connecting the electronic device and the connection cable 1 together.

The first connector main body 3 is connected to a tip of a connection cable main body 1*a* and integrated into an external cover 7 made of an insulating resin by mean of insert molding with the coupling portions thereof being exposed.

The first connector main body 3 includes: a housing 10 made of an insulating resin; a magnet member 11 held by the housing 10 so as to be allowed to swing; a plurality of pinshaped movable contact terminals 5 projected from a coupling-side end face of the housing 10 in such a way that they can be pressed in; and a connection substrate 12 disposed on the rear side of the housing 10.

The housing 10 is made of an insulating resin material and formed in a horizontally-long rectangular parallelepiped shape as illustrated in FIGS. 6A to 6D. The housing 10 includes: a magnet-inserted portion 13 formed in a shape of an elongate hole opened at the opposite ends thereof in the coupling direction and provided at a central portion thereof; a holding notch portion 14 formed in a recessed shape at a rear end edge of the magnet-inserted portion 13; and a rear end closing member 15 for closing the rear end side of the holding notch portion 14.

Figure 7A:
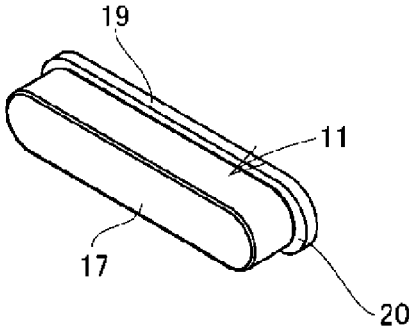
FIG. 7A is a perspective view illustrating a magnet member in FIG. 5.
Figure 7B:
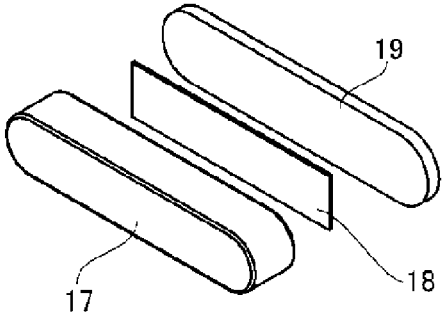
FIG. 7B is an exploded perspective view of the same.
Figure 8:
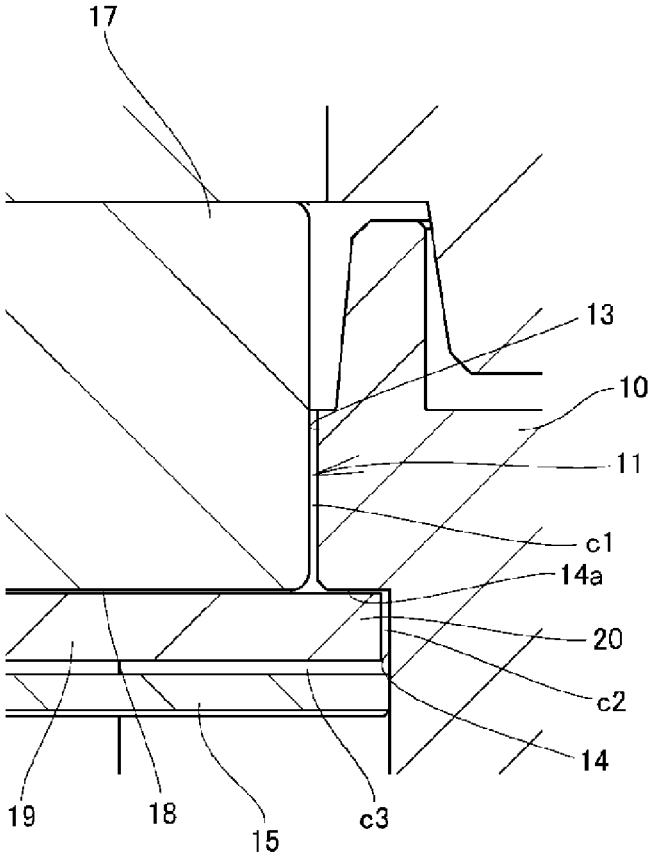
FIG. 8 is a partial enlarged transverse cross-sectional view illustrating a state in a portion of the magnet member.

On the other hand, the magnet member 11 is formed in a protruding shape as illustrated in FIGS. 7A and 7B by fixing a flange plate 19 having a flat-plate shape to a rear end of the magnet 17 formed in a rectangular parallelepiped shape via a fixing means 18 such as an adhesive tape. The magnet member 11 includes a held portion 20 formed in a shape projecting outwardly at a rear end of a magnet portion configured by the magnet 17 to be inserted into the magnet-inserted portion 13.

With the use of the configuration such that the magnet member 11 is formed in a protruding shape by fixing the flange plate 19 to the rear end of the magnet 17, the magnet 17 can have a simple and easy-to-mold shape. Also, the magnet member 11 can accommodate a plurality of coupling heights by changing a thickness of the magnet 17 in the coupling direction. Therefore, a cost reduction can be achieved.

According to the magnet member 11, the magnet 17 is inserted into the magnet-inserted portion 13 from the rear end side of the housing 10; the held portion 20 at the rear end of the magnet member 11 is fitted into the holding notch portion 14; and the rear end side of the holding notch portion 14 is closed by the rear end closing member 15. As a result, the held portion 20 is interposed between a recessed bottom 14*a* of the holding notch portion 14 and the rear end closing member 15. The magnet member 11 is therefore held by the first connector main body 3 so as to be allowed to swing, with the magnet 17 projected from the coupling-side end face of the housing 10.

An adsorption force resulting from a magnetic force of the magnet member 11 is transmitted to the housing 10 with the held portion 20 interposed between the recessed bottom 14*a* of the holding notch portion 14 and the rear end closing member 15.

The magnet 17 is formed by a permanent magnet made of a rare-earth magnet such as a neodymium magnet, for example, and formed in a rectangular parallelepiped shape with the opposite end faces thereof in the coupling direction arranged parallel to each other.

Also, the magnet 17 is formed in a shape such that a cross-section, slightly smaller than a cross-section of an opened portion of the magnet-inserted portion 13 in the coupling direction, is continuously extended in the coupling direction. Thus, a swing clearance c1 is formed between the inner peripheral surface of the magnet-inserted portion 13 and the magnet member 11 when the magnet 17 is inserted into the magnet-inserted portion 13.

The flange plate 19, on the other hand, employs a magnetic material such as stainless steel with a high processing accuracy. The flange plate 19 is formed of such a magnetic material in a flat-plate shape larger than the cross-section of the magnet 17 in the coupling direction.

The outer shape of the flange plate 19, i.e., the cross-section thereof in the coupling direction is formed to be larger than that of the magnet 17 and smaller than that of the holding notch portion 14. The thickness of the flange plate 19 is formed to be smaller than the distance between the recessed bottom 14*a* of the holding notch portion 14 and a front end face of the rear end closing member 15. By fixing the flange plate 19 to the rear end of the magnet 17, the held portion 20 is formed in a shape projecting outwardly at the rear end of the magnet member 11. Also, when the held portion 20 is fitted into the holding notch portion 14, swing clearances c2 and c3 are formed between the held portion 20 and the inner side surface of the holding notch portion 14 and between the rear end closing member 15 and the rear end face of the held portion 20, respectively.

Due to the swing clearances c1, c2, and c3 formed between the inner peripheral surface of the magnet-inserted portion 13 and the magnet portion 17, between the held portion 20 and the inner side surface of the holding notch portion 14, and between the rear end closing member 15 and the rear end face of the held portion 20, respectively, a state in which the magnet member 11 is held by the first connector main body 3 so as to be allowed to swing is obtained. In other words, the magnet member 11 forms a floating structure with respect to the housing 10.

The rear end closing member 15 is formed in a horizontally-long rectangular shape with a metal plate. The rear end closing member 15 closes the rear end side of the holding notch portion 14 by being pressed into the housing 10 through a slit-like insertion hole 21 formed in an upper surface or lower surface of the housing 10.

Figure 9A:
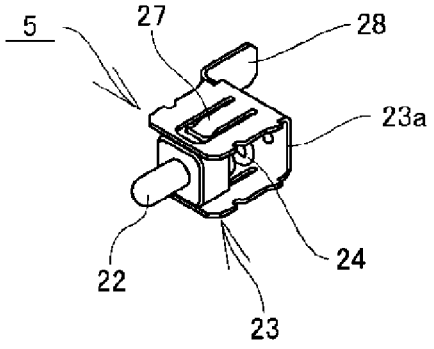
FIG. 9A is a perspective view illustrating a movable contact terminal in FIG. 5.
Figure 9B:
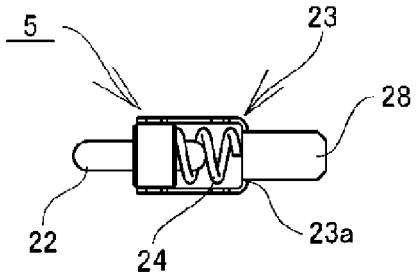
FIG. 9B is a side view of the same.
Figure 10A:
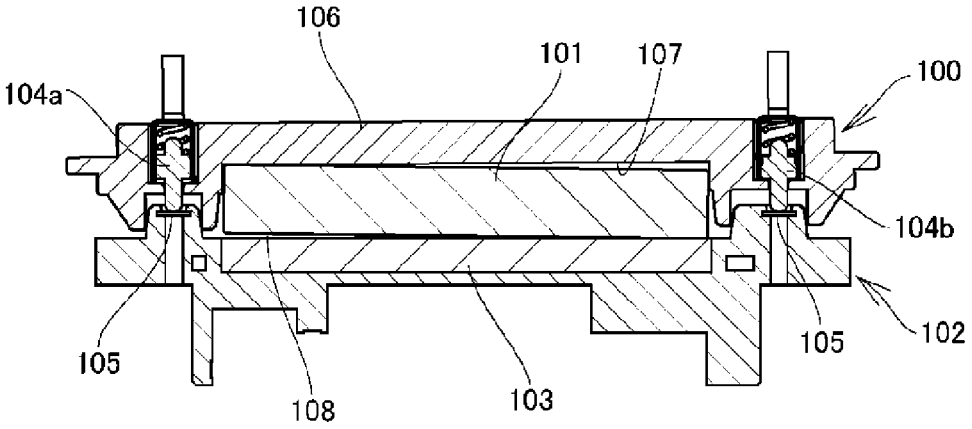
(RELATED ART) FIG. 10A
FIGS. 10A and 10B are each a cross-sectional view illustrating a case where a magnet is fixed to a housing in an inclined manner in a related magnetic coupling connector.
Figure 10B:
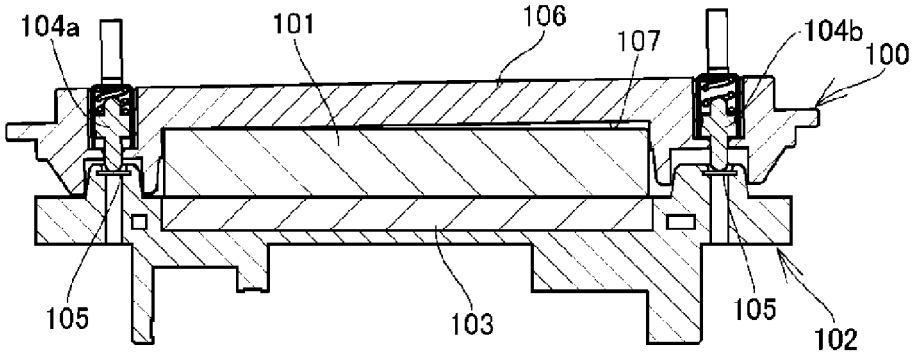
(RELATED ART) FIG. 10B

As illustrated in FIGS. 9A and 9B, the movable contact terminal 5 includes: a slide pin 22 made of a conductive metal material and accommodated in the housing 10 so as to be slidable in the coupling direction; a U-shaped terminal member 23 made of a conductive metal material and having a rear end plate 23*a* disposed on the rear end side of the slide pin 22; and a pushing-out spring 24 disposed between the slide pin 22 and the rear end plate 23*a*. The movable contact terminals 5 are assembled into movable terminal accommodating portions 25 formed at the opposite ends of the housing 10 so as to form a symmetrical arrangement with the magnet member 11 interposed therebetween.

In the movable contact terminal 5, the slide pin 22 and the pushing-out spring 24 are inserted into the movable terminal accommodating portion 25 opened toward the rear end side thereof and the terminal member 23 is then pressed into the movable terminal accommodating portion 25. As a result, the pushing-out spring 24 biases the slide pin 22 toward the pushing-out direction in the coupling direction due to a reaction force from the rear end plate 23*a*. A tip of the slide pin 22 thereby projects from the coupling-side end face of the housing 10 through a projection hole 26 such that it can be pressed in.

The terminal member 23 includes: elastic pressure contact strips 27 that are always being pressed against the outer side surfaces of the slide pin 22 when assembled into the housing 10; and a substrate connection terminal strip 28 formed in a shape extending rearward from a side edge of the rear end plate 23*a*. The substrate connection terminal strip 28 is inserted into a through hole 29 formed in the connection substrate 12.

Reference numeral 16 in the figures denotes a terminal protecting portion integrally formed with the coupling-side end face of the housing 10. The terminal protecting portion 16 surrounds the movable contact terminal 5, projected from the coupling-side end face of the housing 10 in such a manner that it can be pressed in, in order to protect the tip portion of the movable contact terminal 5.

The connection substrate 12 is formed in a rectangular plate shape. The connection substrate 12 includes: the through holes 29 provided at the opposite ends thereof; and cable connection patterns 30 made of a conductive film material and provided at a rear end surface thereof. The substrate connection terminal strip 28 inserted into the through hole 29 is soldered to the cable connection pattern 30, thereby connecting the movable contact terminal 5 to the cable connection pattern 30.

The connection substrate 12 is fixed to the rear end surface of the housing 10 via a waterproof adhesive tape 31. The adhesive tape 31 serves as a packing, thereby sealing a gap between a rear end outer peripheral portion of the housing 10 and a peripheral portion of the fixed surface of the connection substrate 12.

Fixing the connection substrate 12 to the housing 10 via the waterproof adhesive tape 31 as described above makes it possible, without performing a special pretreatment, to prevent a resin from flowing into the inside of the connector main body 3 when the connector main body 3 is integrated into the external cover 7 by means of insert molding. Therefore, the number of steps during the insert molding and the cost thereof can be reduced and a high quality can also be ensured.

The second connector main body 4 includes: a housing 40 made of a synthetic resin; a mate-side magnetic material 41 disposed on a coupling-side end face of the housing 40; and fixed contact terminals 6 made of a conductive metal material. The mate-side magnetic material 41 and the fixed contact terminals 6 are integrated into the housing 40 by means of integral molding.

The mate-side magnetic material 41 is formed in a flat plate shape with a ferromagnetic material such as stainless steel. The mate-side magnetic material 41 is fixed to the housing 40 in such a manner that an adsorption surface thereof is exposed approximately on the same plane with the coupling-side end face of the housing 40.

The fixed contact terminal 6 includes a pressure contact portion 6*a* exposed at a tip of a protruding portion 43 projected from the coupling-side end face of the housing 40. When the connector main bodies 3 and 4 are coupled with each other, the protruding portion 43 is fitted into the terminal protecting portion 16 of the connector main body 3 and the pressure contact portion 6*a* is thereby pressed against the slide pin 22.

According to the thus configured magnetic coupling connector 2, when the connector main bodies 3 and 4 are coupled with each other, the magnet member 11 is held so as to be allowed to swing with respect to the housing 10, i.e., the first connector main body 3. In other words, the magnet member 11 has a floating structure. Thus, even if an inclination occurs between the adsorption surface of the magnet member 11 and that of the mate-side magnetic material 41, the magnet member 11 swings, thereby absorbing such inclination. Therefore, the magnet member 11 and the mate-side magnetic material 41 always adsorb to each other over the entire adsorption surfaces thereof. As a result, no gap occurs between the magnet member 11 and the mate-side magnetic material 41.

Since the magnet member 11 is held by the first connector main body 3 so as to be allowed to swing with respect to the housing 10, i.e., since the magnet member 11 has the floating structure, even when the magnet member 11 is inclined with respect to the housing 10, stroke amounts of the movable contact terminals 5 are not limited thereby.

Furthermore, a reaction force against the adsorption force of the magnet member 11 acting between the housings 10 and 40 is diverged into portions of the movable contact terminals 5 symmetrically provided at the opposite ends of the connector main body 3 with the magnet member 11 interposed therebetween. Therefore, even if the magnet member 11 is inclined with respect to the housing 10, the slide pins 22 are biased in a direction achieving a parallel arrangement between the connector main bodies 3 and 4 due to the biasing force obtained by the pushing-out springs 24 in the movable contact terminals 5. It is therefore possible to obtain a stable connected state.

The embodiment described above is directed to a case where only the magnet member 11 in the first connector main body 3 is held so as to be allowed to swing. However, the mate-side magnet member or magnetic material may also be held by the second connector main body 4 so as to be allowed to swing so that the magnet members or magnetic materials in the connector main bodies 3 and 4 can swing, respectively.

Moreover, the embodiment described above is directed to a case where the magnet 17 is formed in a horizontally-long rectangular parallelepiped shape. However, the shape of the magnet 17 is not limited to the above-described shape. It may be another simple shape such that the same cross-sectional shape continuously appears in the coupling direction (such as a cylindrical shape).

Furthermore, the embodiment described above is directed to a case where the magnet member 11 is formed in a protruding shape having the held portion 20 at the rear end thereof by fixing the flange plate 19 to the magnet 17 by the fixing means 18. However, the held portion 20 may be integrally formed at the rear end of the magnet 17 by molding the magnet in a protruding shape.

Furthermore, the embodiment described above is directed to a case where the connector main body 3 includes the pair of movable contact terminals 5 disposed at the opposite sides of the magnet member 11. However, the connector main body 3 may include a plurality of movable contact terminals arranged in a circumferential direction of the magnet member 11.

Furthermore, the embodiment described above is directed to a case where the movable contact terminal 5, having the slide pin 22 capable of being pressed in, is employed as the contact terminal of the connector main body 3 and the fixed contact terminal 6, having the pressure contact portion 6*a* against which the slide pin 22 is pressed, is employed as the contact terminal of the connector main body 4. However, the contact terminals are not limited to the configuration as described above. For example, the contact terminals may be configured as flat springs to be pressed against each other in the coupling direction with a conductive metal material.

REFERENCE SIGNS LIST

1 Connection cable
2 Magnetic coupling connector
3 First connector main body
4 Second connector main body
5 Movable contact terminal
6 Fixed contact terminal
7 External cover
10 Housing
11 Magnetic member
12 Connection substrate
13 Magnet-inserted portion
14 Holding notch portion
15 Rear end closing member
16 Terminal protecting portion
17 Magnet
18 Fixing means (adhesive tape)
19 Flange plate
20 Held portion
21 Insertion hole

22 Slide pin
23 Terminal member
24 Pushing-out spring
25 Movable terminal accommodating portion
26 Projection hole
27 Elastic pressure contact strip
28 Substrate connection terminal strip
29 Through hole
30 Cable connection pattern
31 Adhesive tape
40 Housing
41 Mate-side magnetic material
42 Fixed contact terminal
43 Protruding portion

The invention claimed is:

1. A magnetic coupling connector comprising:

a first connector main body and a second connector main body to be coupled with each other;

a magnet member disposed in a coupling portion of the first connector main body and a mate-side magnet member or magnetic material disposed in a coupling portion of the second connector main body, the magnet member in the first connector main body adsorbing onto the mate-side magnet member or magnetic material in the second connector main body, thereby coupling the connector main bodies together; and a contact terminal disposed in the coupling portion of the first connector main body and a contact terminal disposed in the coupling portion of the second connector main body, the contact terminals being pressed against each other when coupled, wherein the magnet member is held by the first connector main body so as to be allowed to swing;

the connector main body includes a magnet-inserted portion opened at opposite ends thereof in a coupling direction and into which the magnet member is inserted, a holding notch portion formed in a recessed shape at a rear end edge of the magnet-inserted portion, and a rear end closing member for closing a rear end side of the holding notch portion;

the magnet member includes, at a rear end thereof, a flange-shaped held portion to be fitted into the holding notch portion; and swing clearances are formed between an inner peripheral surface of the magnet-inserted portion and the magnet member, between the held portion and an inner peripheral surface of the holding notch portion, and between the rear end closing member and a rear end face of the held portion, respectively, so that the magnet member is held by the first connector main body so as to be allowed to swing.

2. The magnetic coupling connector according to claim 1, wherein the mate-side magnet member or magnetic material is held by the second connector main body so as to allow the magnet member to swing.

3. The magnetic coupling connector according to claim 1, wherein each of the connector main bodies includes a plurality of the contact terminals symmetrically arranged with the magnet member interposed therebetween.

4. The magnetic coupling connector according to claim 1, wherein the magnet member is formed to have the flange-shaped held portion at the rear end thereof by fixing, to a rear end of a magnet, a flange plate with a size greater than a cross-section of the magnet in the coupling direction.

* * * * *